US006428232B2

(12) United States Patent
McCauley et al.

(10) Patent No.: US 6,428,232 B2
(45) **Date of Patent: *Aug. 6, 2002**

(54) ROLLER BALL PEN WITH ADJUSTABLE SPRING TENSION

(75) Inventors: Bernard J. McCauley, West Point, IA (US); Ryan S. Eddington, Dallas City, IL (US); Michael Huneke, Burlington, IA (US)

(73) Assignee: BIC Corporation, Milford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/837,482

(22) Filed: Apr. 19, 2001

Related U.S. Application Data

(63) Continuation of application No. 09/493,922, filed on Jan. 28, 2000, now Pat. No. 6,261,015.

(51) Int. Cl.[7] ..... B43K 5/16
(52) U.S. Cl. ..... 401/103; 401/251
(58) Field of Search ..... 401/54, 103, 116, 401/186, 188, 209, 259, 260, 251

(56) References Cited

U.S. PATENT DOCUMENTS

| | | | | |
|---|---|---|---|---|
| 2,002,501 A | 5/1935 | Donato | ..... | 176/123 |
| 2,488,179 A | 11/1949 | Engel, Jr. | ..... | 401/54 |
| 3,051,132 A | 8/1962 | Johmann | ..... | 120/42.03 |
| 3,144,005 A | 8/1964 | Johmann | ..... | 120/42.03 |
| 3,232,278 A | 2/1966 | Johmann | ..... | 401/103 |
| 3,419,336 A | 12/1968 | Kirk | ..... | 401/54 |

OTHER PUBLICATIONS

International Search Report, PCT/US01/02522, Filed Jan. 25, 2001.

*Primary Examiner*—David J. Walczak
(74) *Attorney, Agent, or Firm*—Pennie & Edmonds LLP

(57) ABSTRACT

A roller ball pen (2) that permits a user to adjust the bias force that biases a roller ball cartridge (4) out of the pen (2) to suit the user's particular writing style. The pen (2) has a body (8) having distal and proximal ends, a roller ball cartridge (4) disposed in the body (8), a cap (10) removably disposed on the proximal end of the body (8), a control member (14) slidingly disposed in the cap (10), a spring (18) attached to the distal side of the control member (14) and abutting the roller ball cartridge (4), and a drive rod (16) engaged with the control member (14). Rotation of the drive rod (16) moves the control member (14) distally or proximally, thereby adjusting the bias force applied by the spring (18) to the roller ball cartridge (14).

19 Claims, 6 Drawing Sheets

ROLLER BALL PEN WITH ADJUSTABLE SPRING TENSION

CROSS-REFERENCE TO RELATED APPLICATIONS

This is a continuation of application Ser. No. 09/493,922, filed Jan. 28, 2000, now U.S. Pat. No. 6,261,015.

FIELD OF THE INVENTION

The present invention relates generally to pens with replaceable roller ball cartridges.

BACKGROUND OF THE INVENTION

In general roller ball pens have a pen body into which a replaceable roller ball cartridge is held in place such that a user may write with the pen. The roller ball cartridge has a writing tip and a butt end. Usually the pen body has two pieces detachably held together by threads, for example. In order to replace the roller ball cartridge the two pieces are separated and the spent roller ball cartridge is removed and a replacement roller ball cartridge is inserted into one of the two pieces and the other piece is attached back into place. In some cases a spring or other biasing element abuts the butt end of the roller ball cartridge at one end and the inside of the body at the other end, such that the spring biases the writing tip out of the pen body. The spring or biasing element also provides a certain feel to the user, because, depending on the biasing force, the roller ball cartridge will have a certain recoil within the body while the user is writing with the pen. The prior art pens only provide one tension, which is set by design, and a user must be satisfied with the feel of the particular pen chosen. Therefore, there is a need in the art for a roller ball pen for which the user can set the biasing force to meet the user's particular needs.

SUMMARY OF THE INVENTION

A preferred embodiment of roller ball pen includes a pen body with distal and proximal ends, a roller ball cartridge inserted into the pen body (with the writing end extending at least partially out of the distal end of the pen body), a cap detachably attached to the proximal end of the pen body, a drive rod rotatably fixed to the cap, a control member, such as a nut, and a biasing element (preferably a spring) attached to the nut and abutting the butt end of the roller ball cartridge. Preferably, the control member, such as a nut, is slidingly disposed within the cap such that it may move distally or proximally, but may not substantially rotate therein. The drive rod extends at least partially into the cap and is rotatably fixed thereto such that it may not substantially move distally or proximally. The distal end of the drive rod engages the control member, such as a nut, so that rotation of the drive rod will move the nut distally or proximally, thereby changing the biasing force of the spring against the roller ball cartridge. Preferably there is a drive knob fixed to the proximal end of the drive rod and the drive knob is rotatable to rotate the drive rod.

DETAILED DESCRIPTION OF THE PREFERRED EMBODIMENTS

Figure 1:
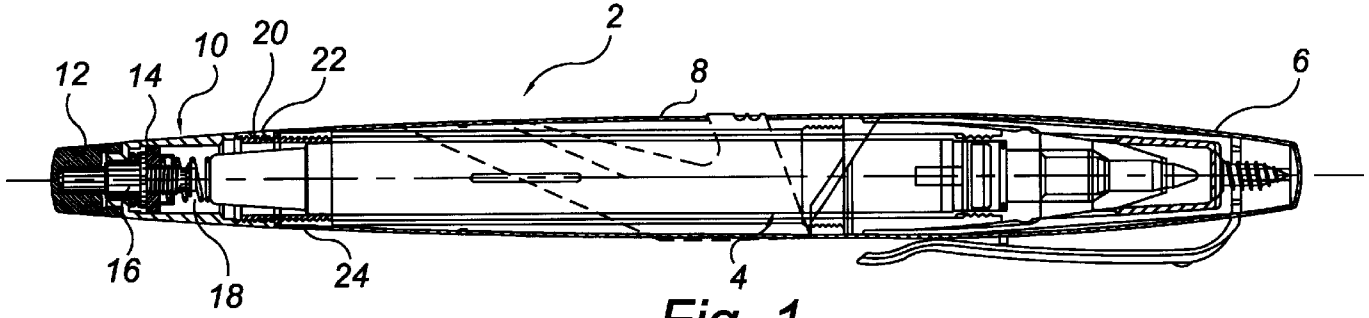
FIG. 1 is a roller ball cartridge pen with adjustable spring tension in accordance with an embodiment of the present invention.

Referring to FIG. 1 there is shown a pen 2 in accordance with an embodiment of the present invention. Pen 2 has roller ball cartridge 4, pen top 6, body portion 8 (also referred to herein as first part of the body and distal part of the writing instrument), cap 10 (also referred to herein as second part of the body and proximal part of the writing instrument), drive knob 12, control member or nut 14, drive rod 16 and spring 18. Bushing 20 is threaded and fixed into distal end 22 of cap 10. Proximal end 24 of body portion 8 is removably secured to cap 10 using bushing 20. Thus, a user may replace roller ball cartridge 4 by unscrewing body portion 8 from cap 10, removing the spent cartridge, inserting a new cartridge and screwing body portion 8 back to cap 10.

Figure 2:
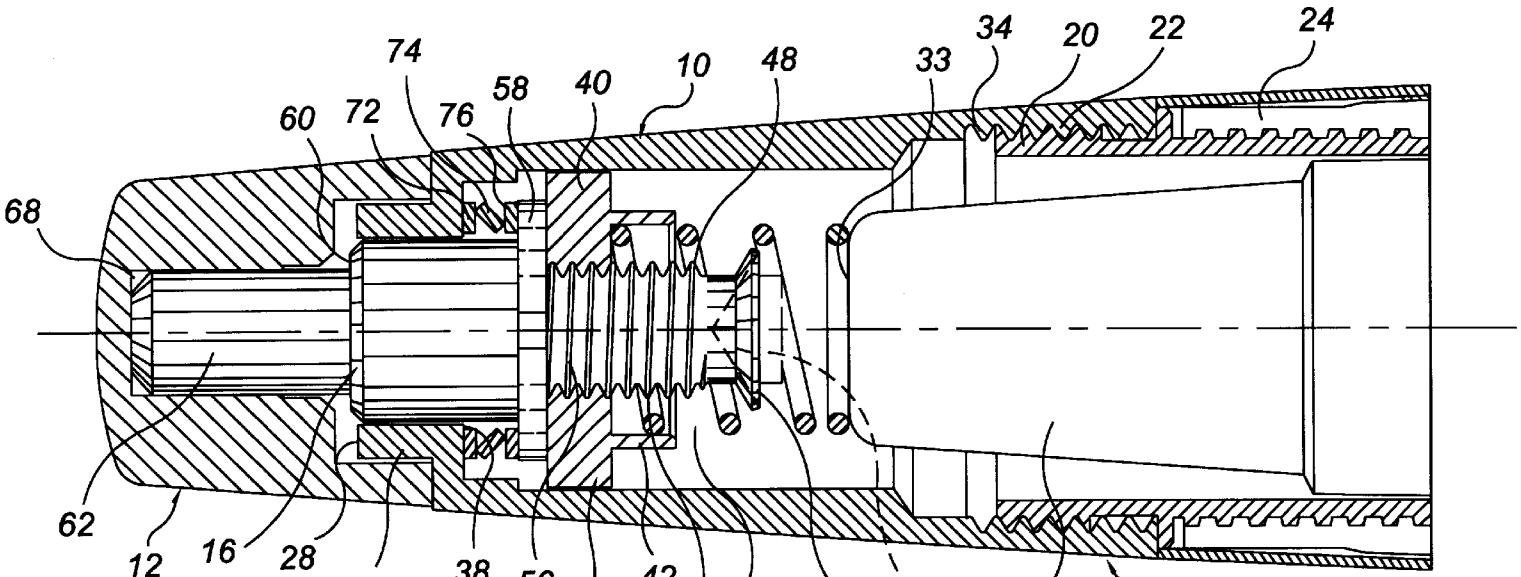
FIG. 2 is a cross-section of the proximal end of the pen of FIG. 1.
Figure 3:
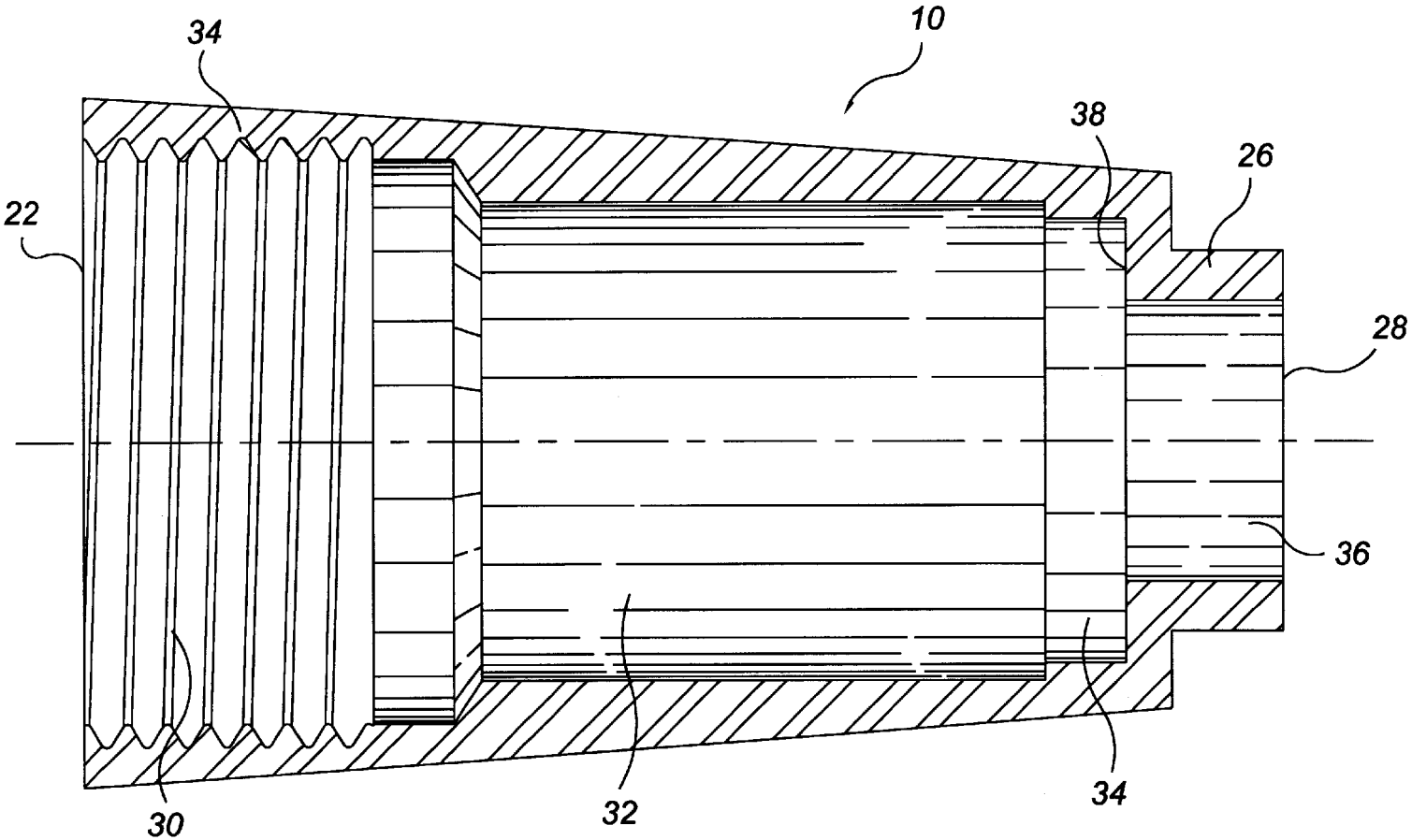
FIG. 3 is a cross-section of a cap of the pen of FIG. 1.

Referring to FIGS. 2 and 3, cap 10 preferably has a tapered cylindrical exterior shape with a straight cylindrical ring 26 at its proximal end 28, which has a smaller outer diameter than cap 10. The interior of cap 10 has first hollow section 30, second hollow section 32, cylindrical cavity 34, and hole 36. First hollow section 30 is configured to fit over butt end 33 of roller ball cartridge 4 and has threads 34 configured to mate with bushing 20, as described above. Second hollow section 32 is configured to receive and engage engagement portion 40 of nut 14, such that nut 14 will not rotate relative to cap 10 and such that nut 14 may move longitudinally within second hollow section 32. Preferably second hollow section 32 has eight sides (not shown) and slidingly receives and mates with nut 14, as described more fully below. A skilled artisan will readily recognize that many shapes other than the preferred eight-sided shape for second hollow section 32 may be used without exceeding the scope of the present invention. For example, and without limitation, any number-sided shape may be used, even as few as a two sided shape. Cylindrical cavity 34 has a smaller diameter than the nominal diameter of second hollow section 32, and a larger diameter than hole 36. The difference in diameters between cylindrical cavity 34 and hole 36 defines shoulder 38.

Figure 4:
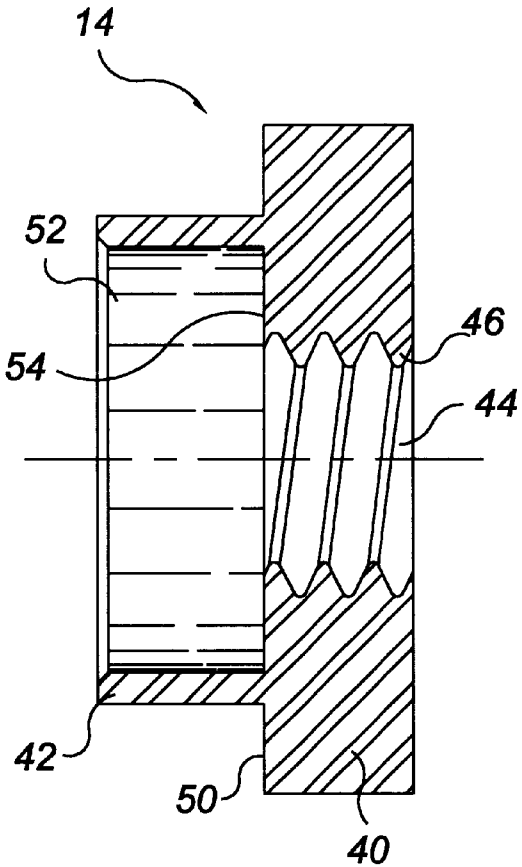
FIG. 4 is a cross-section of a nut of the pen of FIG. 1.

Referring to FIGS. 2 and 4, control member or nut 14 has engagement portion 40 and hollow cylinder 42. The exterior of engagement portion 40 is configured to engage second hollow section 32 of cap 10; preferably it has an octagonal shape as described above. Engagement portion 40 also has a hole 44 therethrough that has threads 46 configured to engage threads 48 of drive rod 16, as more fully described below. Hollow cylinder 42 of nut 14 is attached to or integral with distal side 50 of engagement portion 40. The outer diameter of hollow cylinder 42 is smaller than the nominal outer diameter of engagement portion 40, and the inner diameter is larger than the diameter of hole 44, thereby defining spring cavity 52 with spring abutment 54. Spring cavity 52 is configured to receive and secure spring 18 against spring abutment 54. Preferably, the diameter of spring 18 is slightly larger than the inner diameter of hollow cylinder 42 and spring 18 is secured therein by friction. A skilled artisan will readily recognize other ways to secure spring 18 to nut 14.

Figure 5:
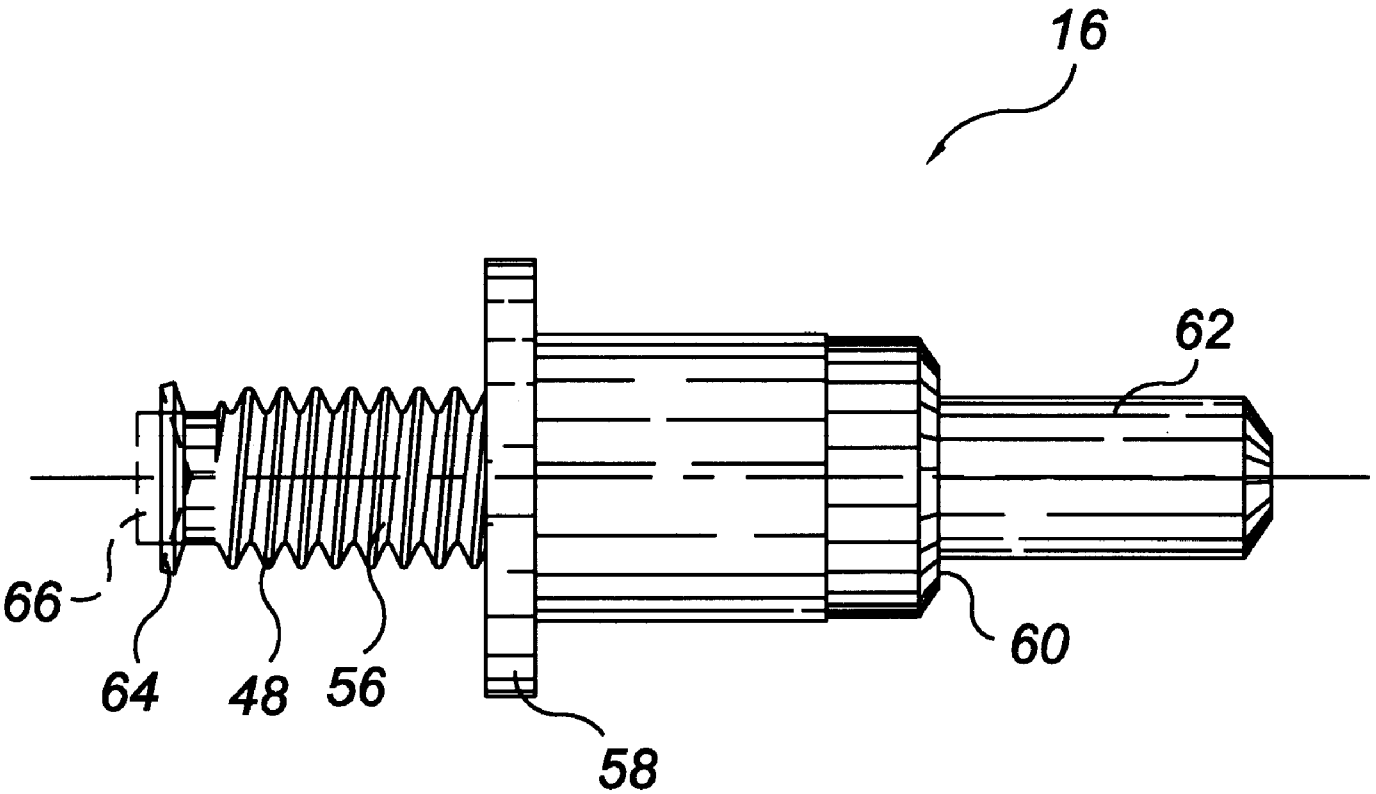
FIG. 5 is a cross-section of a drive rod of the pen of FIG. 1.

Referring to FIGS. 2 and 5, drive rod 16 has threaded portion 56, ring 58, ledge 60 and attachment section 62. Threaded portion 56, as shown, has threads 48 and stop 64. Prior to assembly of pen 2, stop 64 is a straight cylindrical portion 66, as shown in phantom. Once drive rod 16 is installed, straight cylindrical portion 66 is deformed to form stop 64, which prevents drive rod 16 from being completely removed from nut 14.

Figure 6:
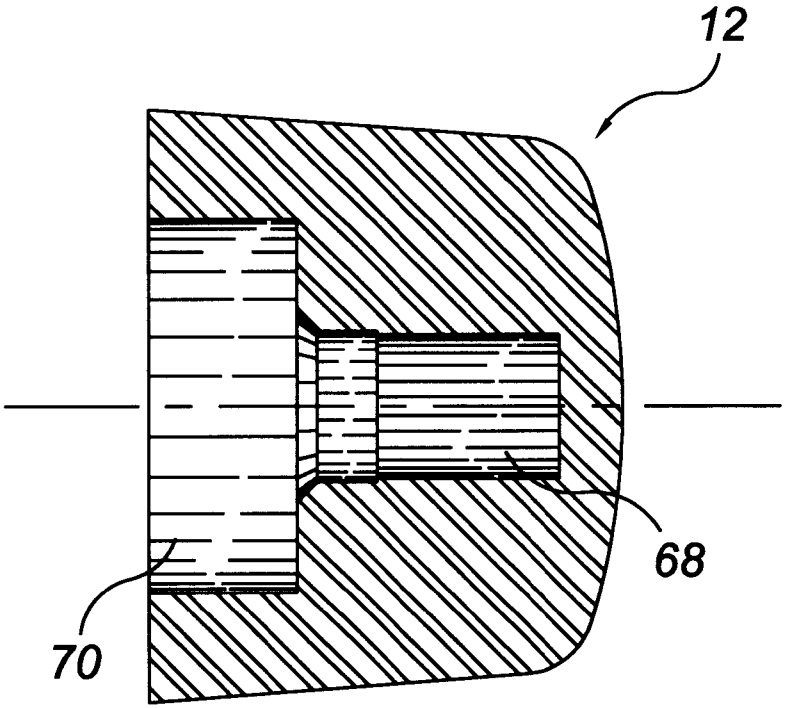
FIG. 6 is a cross-section of a drive knob of the pen of FIG. 1.
Figure 7:
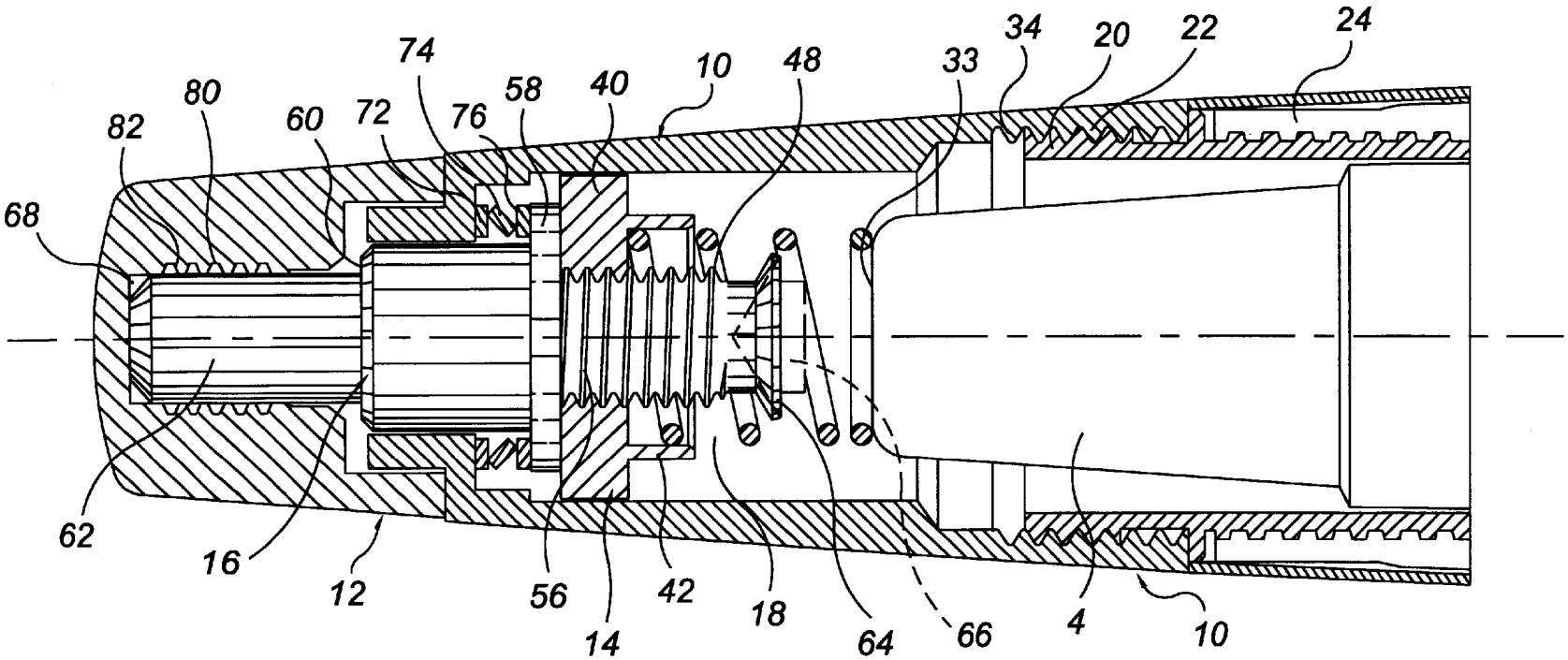
FIG. 7 is a cross-section of another embodiment of the proximal end of the pen of FIG. 1.

Referring to FIGS. 2 and 6, drive knob 12 has first cavity 68 and second cavity 70. First cavity 68 has a slightly smaller diameter than the diameter of attachment section 62 of drive rod 16 and at least the same length. Attachment section 62 is jammed into first cavity 68 of drive knob 12, thereby creating a friction connection between the two pieces. Preferably the surface of attachment section 62 is roughened to provide a better attachment. A skilled artisan will recognize many ways to attach drive knob 12 to drive rod 16, such as, and without limitation, threads 80, 82, as shown in FIG. 7, or adhesive. Second cavity 70 has an inside diameter that is larger than the outside diameter of straight cylindrical ring 26 of cap 10. Second cavity 70 fits over straight cylindrical ring 26 and is held in place by virtue of the attachment of drive knob 12 to drive rod 16, as further discussed below. The exterior of drive knob 12 is preferably tapered to follow the contours of the exterior of cap 10.

Referring to FIG. 2, first circular washer 72, spacer washer 74, and second circular washer 76 are inserted into cap 10, and abut against shoulder 38 of cap 10. Preferably spacer washer 74 is not a flat washer, but rather one with an undulating surface that provides some longitudinal movement when compressed. Attachment section 62 of drive rod 16 is inserted through and out of hole 36 of cap 10, and drive knob 12 is attached thereto, such that ring 58 of drive rod 16 abuts second circular washer 76. In this manner drive knob 12 and drive rod 16 are secured to cap 10. It should be noted that drive knob 12, while secured to cap 10, may freely rotate about its longitudinal axis. After drive rod 16 is installed, engagement portion 40 of nut 14 is inserted, such that the exterior of engagement portion 40 mates with second hollow section 32 of cap 10, as described above. Drive knob 12 is rotated to engage threads 46 of nut 14, thereby advancing nut 14 over drive rod 16 and into cap 10 in the proximal direction. Straight cylindrical portion 66 (shown in phantom) is deformed to create stop 64 that prevents nut 14 from coming off of drive rod 16 during use of the pen. Spring 18 is inserted over drive rod 16 and into hollow cylinder 42 of nut 14, and is secured thereto as described above. With roller ball cartridge 4 in place, cap 10 is attached to body portion 8, and spring 18 biases roller ball cartridge 4 in the distal direction. A user may adjust the biasing force by turning drive knob 12 in one direction or the other, which rotates drive rod 16, and moves nut 14 either distally or proximally. This movement causes spring 18 to compress or decompress, thereby varying the biasing force exerted by spring 18 against roller ball cartridge 4 in accordance with a user's preferred feel.

The skilled artisan will readily recognize that ways other than using drive rod 16 in combination with nut 14 to adjust the tension of spring 18 may be used without exceeding the scope of the present invention. For example, and without limitation, drive knob 12 may be secured directly to cap 10, and have threads to engage with drive rod 16 such that rotation of drive knob 12 would cause drive rod 16 to move within cap 10. Another example would be a ratchet type mechanism.

The materials used to construct roller ball pens are well known in the art. In the present invention it is preferred to use plastic for body portion 8, and brass for cap 10, drive rod 16 and nut 14. As for the other parts of the present invention any suitable material known to those skilled in the art will suffice. Although various embodiments of the present invention have been described, the descriptions are intended to be merely illustrative. Thus, it will be apparent to the skilled artisan that modifications may be made to the embodiments as described without departing from the scope of the claims set forth below.

What is claimed is:

1. A writing instrument comprising:

a body portion with a distal end and a proximal end;

a cartridge with a writing end and a butt end;

a drive rod rotatably coupled to said body portion;

a control member positioned in said body portion for longitudinal movement therein, wherein said control member is associated with said drive rod; and a biasing element positioned between said control member and said cartridge and configured to resiliently bias said cartridge in a distal direction;

wherein rotation of said drive rod moves said control member longitudinally with respect to said drive rod within said body portion, thereby varying the biasing force against said cartridge.

2. A writing instrument according to claim 1, wherein said drive rod has a proximal and a distal end, said control member has a hole therethrough with threads therein, and the drive rod has threads positioned on the distal end thereof that engage the threads of said control member.

3. A writing instrument according to claim 1, wherein said drive rod has a proximal and a distal end, and further comprising:

a drive knob with a threaded cavity therein, wherein said drive knob is rotatably fixed to said body portion; and threads on said drive rod on the proximal end thereof, wherein said proximal end threads engage said threaded cavity of said drive knob, wherein rotation of said drive knob rotates said drive rod within said body portion, thereby moving said control member longitudinally within said body portion.

4. A writing instrument according to claim 1, wherein said control member is a nut and said body includes a cap having an interior configured and dimensioned to prevent said nut from rotating within said cap.

5. A writing instrument according to claim 1, wherein said biasing element is a coil spring.

6. A writing instrument according to claim 4, wherein said cap is detachable from said body.

7. A writing instrument according to claim 1, wherein said drive rod further comprises a stop for preventing said control member from losing association with said drive rod.

8. The writing instrument according to claim 1, wherein:

said control member includes an abutment surface configured and dimensioned for association with said biasing element; and said biasing element is associated with said abutment surface.

9. A writing instrument comprising:

a body portion with a distal end and a proximal end;

a cartridge with a writing end and a butt end;

a drive rod coupled to said body portion for rotational movement relative to said body;

a control member positioned in said body portion, wherein said control member is associated with said drive rod; and a biasing element positioned between said control member and said cartridge and configured to resiliently bias said cartridge in a distal direction;

wherein rotation of said drive rod moves said control member longitudinally with respect to said drive rod within said body portion.

10. The writing instrument of claim 9, wherein said control member is non-rotatable within said body.

11. A writing instrument according to claim 9, wherein said drive rod has a proximal and a distal end, said control member has a hole therethrough with threads therein, and said drive rod has threads positioned on said distal end thereof that engage the threads of said control member.

12. A writing instrument according to claim 9, wherein said drive rod has a proximal and a distal end, and further comprising:

a drive knob with a threaded cavity therein, wherein said drive knob is rotatably fixed to said body portion;

and threads on said drive rod on said proximal end thereof, wherein said proximal end threads engage said threaded cavity of said drive knob, wherein rotation of said drive knob rotates said drive rod within said body portion, thereby moving said control member longitudinally within said body portion.

13. A writing instrument according to claim 9, wherein said control member is a nut and said body includes a cap having an interior configured and dimensioned to prevent said nut from rotating within said cap.

14. A writing instrument according to claim 9, wherein said biasing element is a coil spring.

15. A writing instrument to claim 13, wherein said cap is detachable from said body.

16. A writing instrument according to claim 9, wherein said drive rod further comprises a stop for preventing said control member from losing association with said drive rod.

17. The writing instrument according to claim 9, wherein:

said control member includes an abutment surface configured and dimensioned for association with said biasing element;

said biasing element is associated with said abutment surface and;

wherein said biasing element applies a biasing force against said cartridge.

18. A method of adjusting the tension of a biasing element against a cartridge in a writing instrument, said method comprising:

providing a cartridge having a writing end and a butt end within a cavity defined within a writing instrument having a distal part and a proximal part coupled to said distal part, said writing end extending through an opening in said distal part;

associating a drive rod having a distal end and a proximal end with said proximal part for rotational movement relative thereto;

associating a control member with said distal end of said drive rod for non-rotational movement relative thereto;

positioning a biasing element between said control member and said butt end of said cartridge; and rotating said drive rod to cause said control member to move longitudinally relative to said cartridge and thereby compress or decompress said biasing element to adjust the biasing force of said biasing element on said cartridge and consequently said writing end.

19. A method of adjusting the tension of a biasing element against a cartridge in a writing instrument, said method comprising:

providing a cartridge having a writing end and a butt end within a cavity defined within a writing instrument having a distal part and a proximal part coupled to said distal part, said writing end extending through an opening in said distal part;

associating a drive rod having a distal end and a proximal end with said proximal part;

associating a control member with said distal end of said drive rod;

positioning a biasing element between said control member and said butt end of said cartridge; and moving said drive rod to cause said control member to move relative to said drive rod and said cartridge and thereby compress or decompress said biasing element to adjust the biasing force of said biasing element on said cartridge and consequently said writing end.

* * * * *

UNITED STATES PATENT AND TRADEMARK OFFICE

CERTIFICATE OF CORRECTION

PATENT NO. : 6,428,232 B2 
DATED : August 6, 2002
INVENTOR(S) : Bernard J. McCauley, Ryan S. Eddington and Michael Huneke It is certified that error appears in the above-identified patent and that said Letters Patent is hereby corrected as shown below:

Column 4,
Line 48, after "body", insert -- portion --;

Column 5,
Line 32, after "body", insert -- portion --.

Signed and Sealed this

Eighteenth Day of February, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,428,232 B2 
DATED : August 6, 2002
INVENTOR(S) : Bernard J. McCauley, Ryan S. Eddington and Michael Huneke It is certified that error appears in the above-identified patent and that said Letters Patent is hereby corrected as shown below:

Column 4,
Lines 12, 14, 15, 23, 34, 39, 40, 59, 61 and 63, delete "portion"; and
Line 42, after "includes", insert -- a body portion and --.

Column 5,
Lines 6, 18, 23 and 24, delete "portion"; and
Line 26, after "includes", insert -- a body portion and --.

Signed and Sealed this

Twenty-sixth Day of August, 2003

JAMES E. ROGAN
*Director of the United States Patent and Trademark Office*